US005859497A

United States Patent [19]

Anderson et al.

[11] Patent Number: 5,859,497

[45] Date of Patent: Jan. 12, 1999

[54] STAND-ALONE SPACER FOR A FLAT PANEL DISPLAY

[75] Inventors: Clifford L. Anderson, Tempe; Lawrence N. Dworsky, Scottsdale; Sai Yu, Tempe, all of Ariz.

[73] Assignee: Motorola, Schaumburg, Ill.

[21] Appl. No.: 573,798

[22] Filed: Dec. 18, 1995

[51] Int. Cl.[6] ..... H01J 1/88; H01J 19/42

[52] U.S. Cl. ..... 313/495; 313/309; 313/482; 313/292

[58] Field of Search ..... 313/495, 309, 313/482, 292, 238

[56] References Cited

U.S. PATENT DOCUMENTS 5,205,770 4/1993 Lowrey et al. ..... 313/292
5,448,131 9/1995 Taylor et al. ..... 313/309
5,492,234 2/1996 Fox, III ..... 216/25
5,543,683 8/1996 Haven et al. ..... 313/292
5,561,343 10/1996 Lowe ..... 313/482

*Primary Examiner*—Sandra L. O'Shea
*Assistant Examiner*—Joseph Williams
*Attorney, Agent, or Firm*—Eugene A. Parsons

[57] ABSTRACT

A stand-alone spacer for use in a flat-panel display includes a plurality of members being joined at a common axis. A first one of the members is a load-bearing member; a second one of the members is a stabilizing member. The load bearing member extends into the face plate and backplate of the display to provide standoff of mechanical forces. The load bearing member has an aspect ratio within the range of 2:1 to 20:1. The stand-alone spacer has a tipping angle within the range of 20 to 90 degrees so that, after placement on one of the display plates, the spacer is able to remain upright throughout the subsequent packaging and evacuation steps in the fabrication of the display.

9 Claims, 7 Drawing Sheets

100

100

100

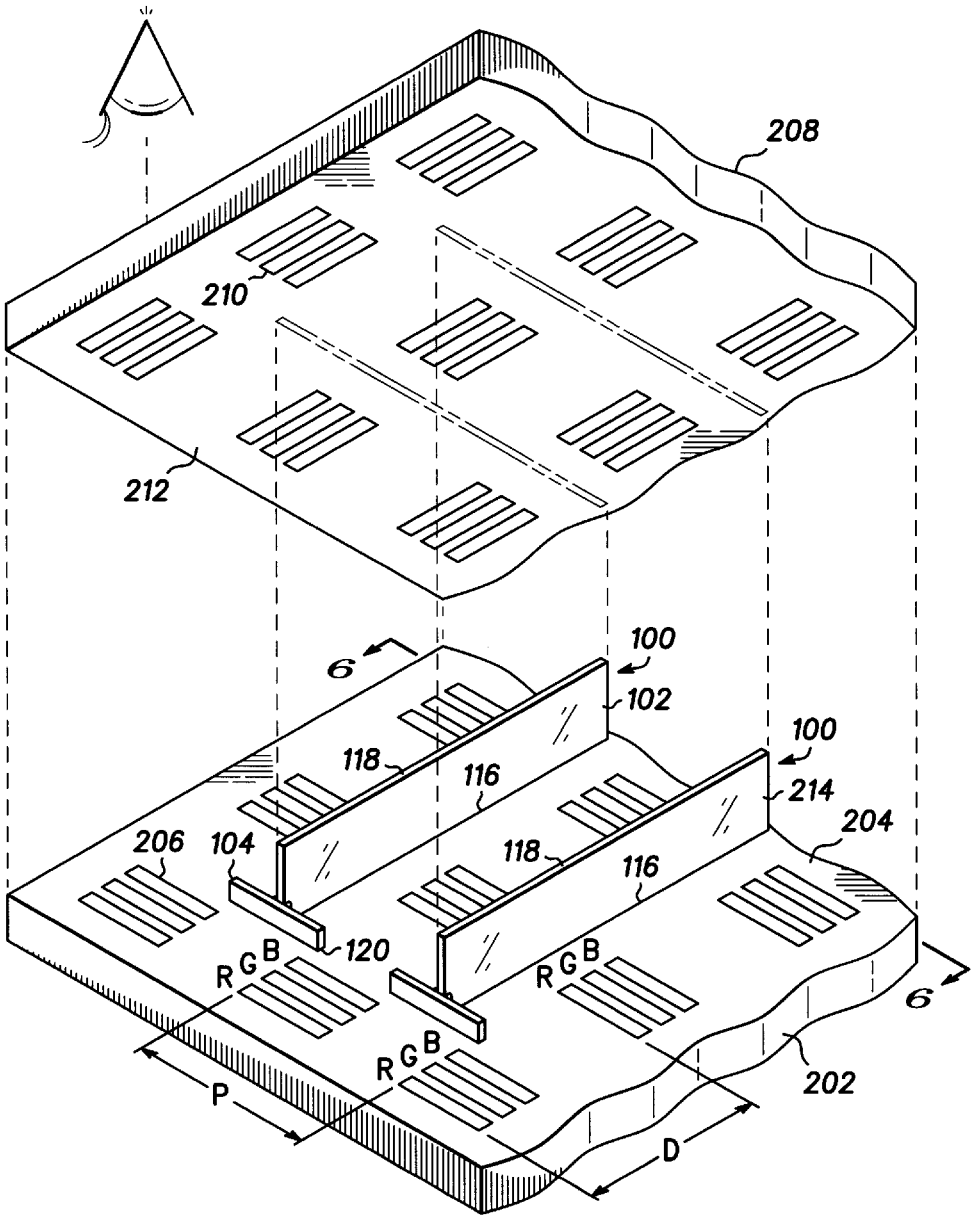
200 FIG. 5

300

400

500

600

STAND-ALONE SPACER FOR A FLAT PANEL DISPLAY

FIELD OF THE INVENTION

The present invention pertains to the area of flat panel displays, such as field emission displays, and more specifically to spacer structures which are used to maintain a fixed spacing between the back plate and face plate of a substantially evacuated flat panel display.

BACKGROUND OF THE INVENTION

Spacers for maintaining a predetermind spacing between the front and back plates of an evacuated flat panel display are known in the art. In a field emission display spacers provide voltage isolation between the display face, or anode structure, and the emitter assembly, or cathode structure; they also provide standoff of the mechanical forces of vacuum within the assembly. However, known prior art spacers suffer from a number of shortcomings. Some prior art spacers require elaborate fabrication steps or additional costly lithographic steps in the fabrication of the display. The additional spacer processing steps add to the cost and reduce yield. Other prior art spacers require attachment steps to affix the spacers to one of the plates of the display so that they will remain upright during subsequent packaging steps. These steps may introduce adhesive materials which outgas and thereby deleteriously affect the vacuum conditions in a field emission display. The additional attachment steps also significantly increase the fabrication time and cost of the display, since, often, each spacer must be attached individually. Bonding of spacers to the display plates is frequently performed at elevated temperature, thereby limiting the choice of spacer material to one which has a coefficient of thermal expansion substantially equaling the coefficient of thermal expansion of the display plate to which the spacers are attached. The requirement of a support structure to maintain upright spacer positioning during the final packaging steps, as well as an example of a field emission display and a packaging method for its fabrication (col. 8, line 34—col. 9, line 17), are taught in U.S. Pat. No. 5,448,131, to Taylor et al, which is incorporated herein by reference.

Other spacers that are known in the art have height-to-width ratios, or aspect ratios, which are inadequate for use in field emission displays, which require spacer aspect ratios of 2:1 or greater.

Accordingly, there exists a need for a spacer which overcomes at least some of the shortcomings of the prior art.

SUMMARY OF THE INVENTION

This need and others are substantially met through the provision of a stand-alone spacer for a flat panel display including a plurality of members joined at a common axis. Each member of the stand-alone spacer has first and second opposed edges. The first opposed edge of each member has a generally flat surface and is positioned in a common plane. A first one of the plurality of members is a load-bearing member and has an aspect ratio (the ratio of maximum height to maximum width) in the range of 2:1 to 20:1. The maximum height of the first one of the plurality of members is substantially equal to the predetermined spacing between inner surfaces of the backplate and face plate of the flat panel display. The stand-alone spacer has a tipping angle in the range of 20–90 degrees so that when the stand-alone spacer is positioned in an upright position on the planar, inner surface of one of the display plates so that the common plane of the stand-alone spacer is in abutting engagement with the planar, inner surface of the plate, the spacer maintains its upright position during the subsequent packaging and evacuation steps in the fabrication of the display.

Further in accordance with the principles of the present invention, there is disclosed herein a stand-alone spacer for a flat panel display. The display has a backplate and a face plate. The stand-alone spacer comprises at least one member having first and second opposed edges. The first opposed edge of the at least one member is positioned in a common plane. A first member of the at least one member has an aspect ratio in the range of 2:1 to 20:1. The maximum height of the first member of the at least one member is substantially equal to a predetermined spacing between inner surfaces of the backplate and face plate of the flat panel display. The stand-alone spacer has a tipping angle in the range of 20–90 degrees so that when the stand-alone spacer is positioned upright on the inner surface of one of the display plates so that the common plane of the stand-alone spacer is in abutting engagement with the inner surface, the stand-alone spacer maintains its upright position during the subsequent packaging steps in the fabrication of the display. The stand-alone spacer maintains the predetermined spacing between the inner surfaces of the back plate and faceplate of the flat panel display after the remaining one of the display plates has been positioned in abutting engagement with the second opposed edge of the at least one member.

Further in accordance with the principles of the present invention, there is disclosed herein a field emission display comprising a cathode plate having a first surface including a plurality of field emission devices and an anode plate having a second surface including a plurality of cathodoluminescent phosphor deposits. The second surface of the anode plate is positioned directly opposed to the first surface of the cathode plate. The first surface is spaced-apart from the second surface by a predetermined distance. The field emission display further comprises a plurality of stand-alone spacers. Each of the plurality of stand-alone spacers includes a plurality of members having first and second opposed edges. The first opposed edge of each of the plurality of members has a generally flat surface and is positioned in a common plane. The members are joined together at a common axis. A first one of the plurality of members is a load-bearing member and has a height substantially equal to the predetermined distance between the first surface of the cathode plate and the second surface of the anode plate. The first one of the members has an aspect ratio in the range of 2:1 to 20:1. The plurality of spacers are positioned on the first surface of the cathode so that the common plane of each of the plurality of spacers is in abutting engagement with the first surface. The anode plate is positioned in abutting engagement with the second opposed edge of the first one of the plurality of members of each of the plurality of stand-alone spacers. The first member of each of the plurality of spacers extends generally perpendicularly into both the cathode and anode plates so that the load-bearing, first members maintains the pre-determined distance between the first surface of the cathode plate and the second surface of the anode plate. Upon evacuation of the display, the resultant deflection of the anode and cathode plates provides sufficient physical contact between the stand-alone spacers and the first surface of the cathode plate and the second surface of the anode plate so that the upright positioning of the spacers is maintained during normal use of the display.

Still further in accordance with the principles of the present invention, there is disclosed herein a flat panel display comprising a backplate having a first, inner surface and a face plate having second, inner surface. The flat panel display further comprises a plurality of stand-alone spacers. Each of the plurality of stand-alone spacers includes a plurality of members having first and second opposed edges. The first opposed edge of each of the plurality of members is positioned in a common plane. The members are joined together at a common axis. A first one of the plurality of members is a load-bearing member and has a height substantially equal to the predetermined distance between the inner surface of the backplate and the inner surface of the face plate. The first one of the members also has an aspect ratio in the range of 2:1 to 20:1. The plurality of spacers is positioned on the first surface of the backplate so that the common plane of each of the plurality of stand-alone spacers is in abutting engagement with the inner surface of the backplate. The anode plate is positioned in abutting engagement with the second opposed edge of the first one of the plurality of members of each of the plurality of stand-alone spacers, the first member of each of the plurality of spacers extending generally perpendicularly into both the backplate and face plate so that the load-bearing, first members maintain the pre-determined distance between the first surface of the backplate and the second surface of the face plate.

BRIEF DESCRIPTION OF THE DRAWINGS

Referring to the drawings:

FIG. 5 is an expanded view of a field emission display illustrating the positioning of stand-alone spacers on the cathode and anode plates of a field emission display in accordance with the present invention.

DESCRIPTION OF THE PREFERRED EMBODIMENTS

Figure 1:
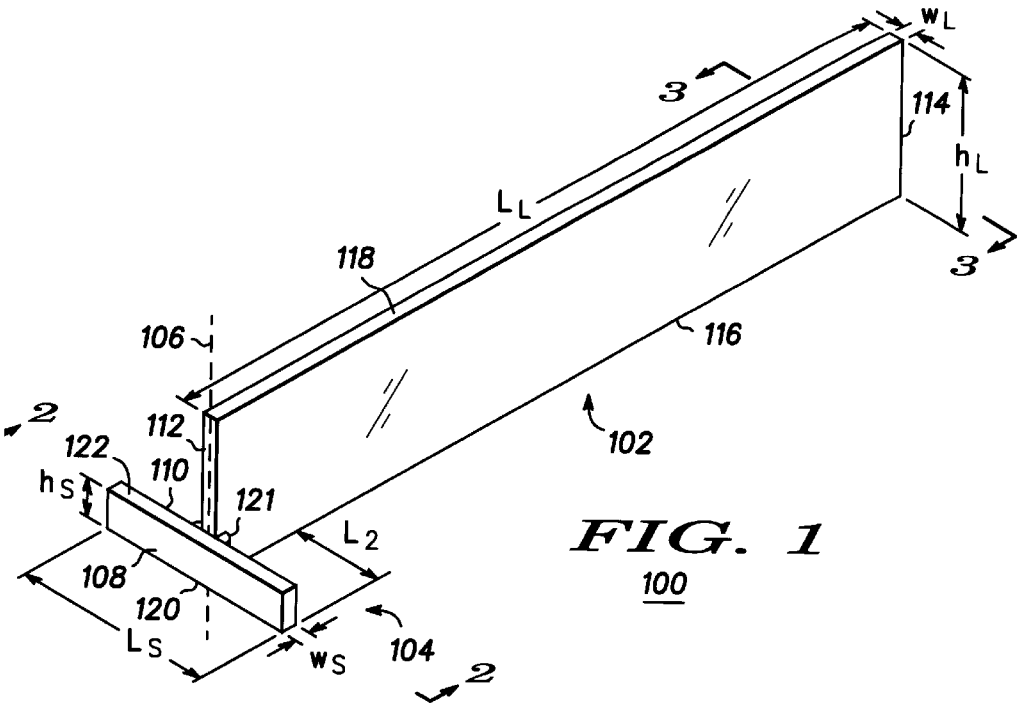
FIG. 1 is an isometric view of an embodiment of a stand-alone spacer in accordance with the present invention.
Figure 2:
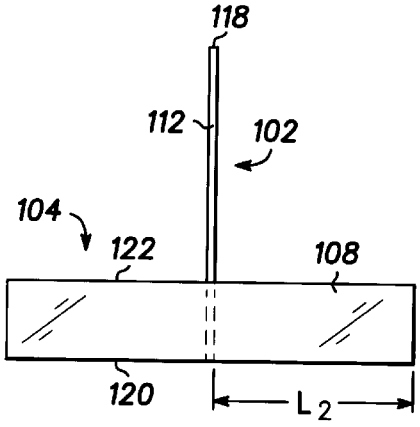
FIG. 2 is an elevational view taken along the line 2—2 of FIG. 1.
Figure 3:
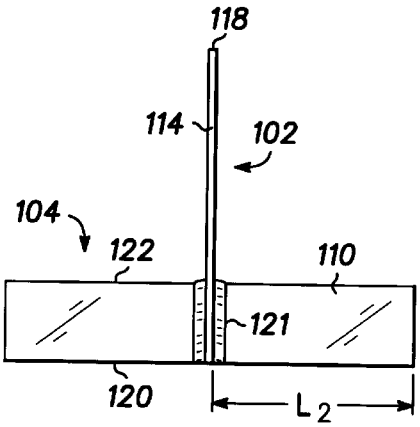
FIG. 3 is an elevational view taken along the line 3—3 of FIG. 1.

Referring now to FIG. 1 there is depicted an isometric view of an embodiment of a stand-alone spacer 100 in accordance with the present invention. In FIGS. 2 and 3 there are depicted side elevational views of spacer 100, taken along the lines 2—2 and 3—3, respectively, of FIG. 1. They are included to aid understanding of FIG. 1. Stand-alone spacer 100 includes a first member 102 and a second member 104 joined together at a common axis 106. Second member 104 has first and second opposed faces 108, 110. First member 102 has first and second opposed ends 112, 114. Member 102 has first and second opposed edges 116, 118; member 104 has first and second opposed edges 120, 122. Common axis 106 lies on a line parallel to, and passing through the midsection of face 112, the line also being perpendicular to edge 116. In this specific embodiment, members 102 and 104 are positioned at 90 degrees with respect to one another and include flat plates made of ceramic. However, the plates may be positioned at angles in the range less than 90 degrees and greater than 0 degrees. Also, other materials can be used, such as glass. In general the material from which members 102, 104 are fabricated must have the following qualities. It must be electrically insulating, capable of withstanding a potential gradient of 1000–5000 volts per millimeter. Second, it must have sufficient compressive strength and buckling strength to withstand the force exerted by the anode structure against the cathode structure in the presence of a vacuum (FIG. 5). Third, it must be sufficiently robust as to survive handling and assembly operations. Finally, it must be substantially free from outgassing when in a vacuum environment having a pressure of approximately $10^{-7}$ torr.

Figure 10:
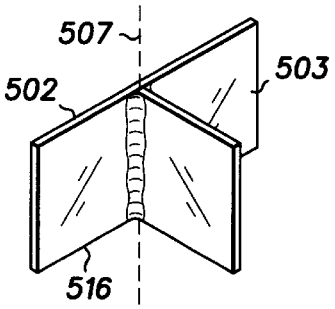
Figure 12:
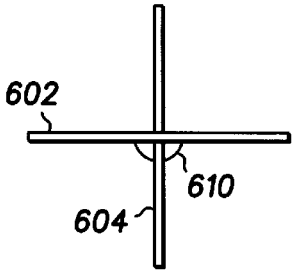
FIG. 12 is a top plan view of the embodiment depicted in FIG. 11.
Figure 14:
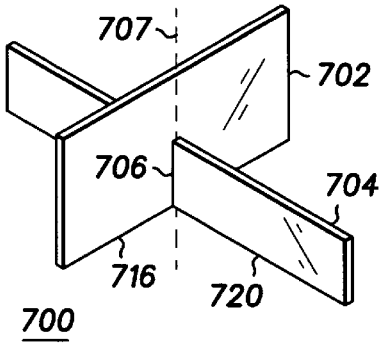
FIG. 14 is an isometric view of the embodiment depicted in FIG. 13.

Second opposed face 110 of member 104 is in abutting engagement with first opposed end 112 of member 102. Second opposed face 110 is affixed to first opposed end 112 by applying a devitrifying frit 121 generally in the area where the two members meet. In alternative embodiments members 102, 104 can be joined together by alternative methods, such as anodic bonding or joining with notches (FIGS. 10, 12, 14). Opposed edges 116, 118, and 120 have generally flat surfaces so that they can make physical contact with the planar, inner surfaces of the display. First edges 116, 120 are positioned in a common plane. Spacer 100 is positioned upright on a generally flat surface, such as the planar inner surface of the back plate or the faceplate of a display, by using a handling method, such as pick-and-place, so that first edges 116 and 120 are placed in abutting engagement with the generally flat surface. As will be described in detail later, stand-alone spacer 100 remains upright, even when the generally flat surface is subjected to minor mechanical disturbances. In this specific embodiment, member 102, a load-bearing member, has a height, hL, of about 1 millimeter and a width, wL, of about 100 micrometers. The height, hL, is substantially equal to the distance between the inner surfaces of the back plate and the faceplate of the display in which stand-alone spacer 100 will be incorporated. When incorporated in a field emission display, width, wL, is such that edge 116 can be placed in abutting engagement with the surface between the pixels of field emitters of the cathode structure, and edge 118 can be placed in abutting engagement with the surface between the cathodoluminescent phosphor coatings of the anode structure. The available surfaces between pixels of emitters, and the available surfaces between phosphor dots or strips, have widths in the range of 50–200 micrometers. The width of the space between the phosphor deposits tends to be smaller than the width of the space between emitter pixels. Thus, in an alternative embodiment, spacer 100 can have a width, $w_L$, which tapers in the direction from cathode to anode so that spacer 100 has a wider base, or edge 116, and a narrower apex, edge 118.

In general, stand-alone spacer 100 has an aspect ratio, or ratio of height to width, greater than, or equal to, 2:1. In this definition the height is equal to the maximum height of member 102 and the width is equal to the maximum width of member 102. This restriction is determined by the spacing of the plates of the display and the distance between emitter pixels which is available for placement of spacers. Member 104, the stabilizing member, has a width, wS, which is about 70 micrometers, in order to fit between the pixels of a cathode plate as will be described in detail in the discussion of FIG. 5.

In this specific embodiment, the height, hS, of member 104 is less than the height, hL, of member 102. The height of member 104 is minimized in order to minimize potential interferences of spacer 100 with the field emission function of the display and in order to minimize disturbance of the fragile cathodoluminescent material on the anode plate. Any physical structure that is positioned in the emitting region of the display, such as spacer 100, can interfere with electron emission in several ways. Thus, it is desirable to minimize the amount of additional structural material, beyond that required to support differential atmospheric pressure, in order to prevent adverse effects on field emission. A physical structure can interfere with electron emission by physically blocking the electrons as they traverse the region between the cathode and anode plates. Alternatively, the physical structure can become electrically charged and, thus, alter the properties of the electric field in the region of the charged structure, thereby modifying the trajectories of the emitted electrons in the region of the structure. These effects are minimized by making member 104 shorter than member 102. Member 102, thus, acts as a load-bearing member providing the standoff between the plates of the display, while member 104 acts as a stabilizing member enabling spacer 100 to retain its upright position the during subsequent display fabrication steps. The manner in which the shorter height, hS, minimizes disturbance of the cathodoluminescent material will be described in detail below (FIG. 5).

Figure 4:
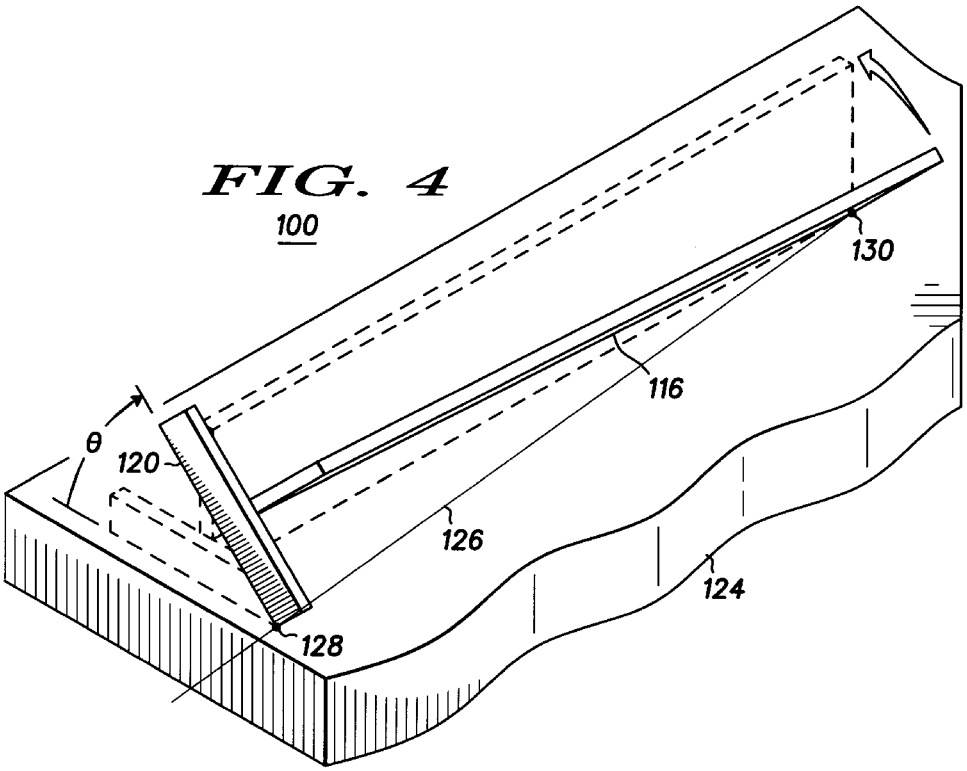
FIG. 4 is an isometric view of spacer 100 tipped, or angularly displaced, by an angle theta from its original, upright position.

Referring now to FIG. 4 there is depicted spacer 100 angularly displaced, by an angle theta, from its original upright position, which is depicted by dashed lines. Spacer 100 is designed so that it will remain upright, or erect, when positioned on the planar, inner surface of one of the plates of a display and so that it will remain upright during the subsequent, final packaging and evacuation steps in the fabrication of the display. The dimensions of first and second members 102 and 104 are determined so that spacer 100 will return to an upright position if tipped over somewhat. This situation can be characterized via a maximum displacement angle, the tipping angle. Spacer 100 can be angularly displaced, by an angle theta, due mechanical disturbances. Theta is the angle between the common plane of first edges 116, 120 of tipped spacer 100 and the planar surface 124 of the display plate on which spacer 100 was originally positioned. The vertex of the angle lies on a line 123 through the contact points 124, 126 of tipped spacer 100 with planar surface 124. The tipping angle is within the range of 20–90 degrees. If the angular displacement, theta, is greater than the tipping angle, spacer 100 falls over completely and is not able to regain its upright position. By performing a balance of moments for spacer 100 when angularly displaced, an equation can be derived which relates the tipping angle to the dimensions of spacer 100. For the specific embodiment of FIG. 1, the relevant, approximate equation from a balance of moments is:

$$\text{tipping angle}=\arctan\left((L2+w_L)/h_L\right),$$

for $L_L$ which is much greater than $L_2$, where L2 is the length of member 104 which lies on one side of member 102, as indicated in FIG. 1, and $h_L$ and $L_L$ are the height and length, respectively, of member 102.

For example, in this specific embodiment, $L_L$ is 5 millimeters. Choosing a tipping angle of 35 degrees yields an L2 of 0.6 millimeters (which is substantially less than $L_L$), given an $h_L$ Of one millimeter and a $w_L$ of 0.1 millimeter. Thus, the length, Ls, of stabilizing member 104 is at least 1.3 millimeters (a length of 0.6 mm from each of the two faces of member 102 and a length of 0.1 mm in abutting engagement with opposed end 112 of member 102). In FIG. 4, theta is less than the tipping angle. So, tipped, or displaced, spacer 100 returns to its upright position, which is indicated generally by an arrow.

In the fabrication of spacer 100, member 104 is initially longer than its specified length, $L_s$, perhaps 5 mm, and contains a scribe mark on one side. The scribe allows the excess lenghth to be broken off after member 104 has been affixed to member 102. An initially longer member 104 facilitates handling and accurate assembly, such as achieving coplanar first edges 116, 120. The final, shorter length of member 104 is desirable to minimize the probability of member 104 overlapping pixels and, thereby, interfering with the proper functioning of the display.

Figure 23:
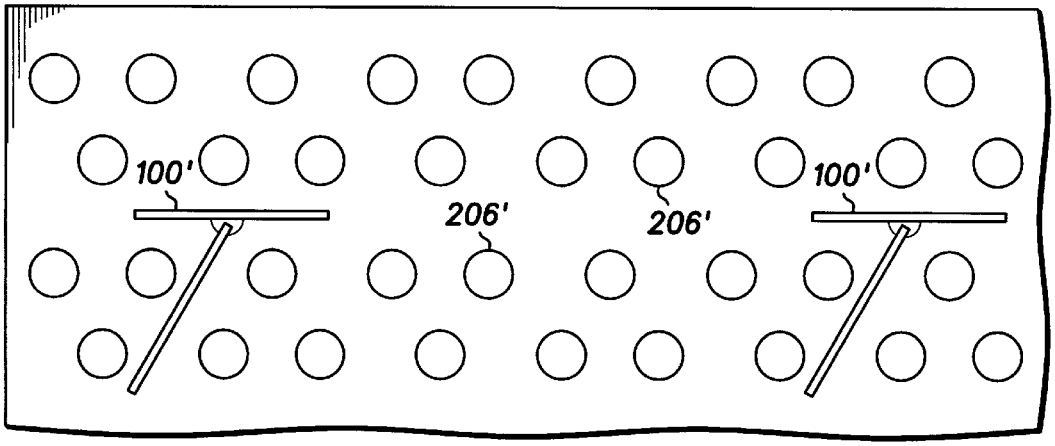
FIG. 23 is a simplified, top plan view of a cathode structure having an alternative pixel layout and illustrates an application of the embodiment of FIG. 16.

Referring now to FIG. 5 there is depicted an exploded view of a field emission display 200 having a plurality of stand-alone spacers 100 in their upright position. In the fabrication of display 200, spacers 100 are positioned on a cathode plate 202, which is the back plate of field emission display 200, so that edges 116 and 120 are in abutting engagement with a substantially flat, inner surface 204 of cathode plate 202. Spacers 100 are positioned between pixels 206, which include a plurality of field emission devices (not shown). Surface 204 includes the regions between pixels 206 which are available for the placement of spacers 100. In the specific configuration of pixels depicted in FIG. 5, surface 204 can easily accommodate a T-shaped spacer, such as the embodiment of FIGS. 1–4. In alternative embodiments, which will be described later, the angle between members 102 and 104 can be chosen to conform to different geometries of available surface 204 which arise from alternative pixel layouts (FIG. 23). Each red-green-blue pixel (denoted by an "R", "G", and "B", respectively, in FIG. 5), in the layout of this specific application, has a pitch, P, of 325 micrometers and a depth, D, of 325 micrometers. Spacers 100 need not be placed between all pixel groups; the number of spacers 100 is predetermined and is greater than or equal to a number of spacers which is sufficient to prevent the collapse of the display when it is evacuated and is under external atmospheric pressure.

Further illustrated in FIG. 5 is the physical contact made between spacers 100 and an anode plate 208, which comprises the faceplate of field emission display 200. Anode plate 208 includes a planar, inner surface 212 which includes the regions between a plurality of cathodoluminescent phosphor deposits 210. Display 200 is observed by viewing the faceplate, or anode plate 208, as illustrated by an eye in FIG. 5. In the fabrication of field emission display 200, spacers 100 are placed on cathode plate 202, by a method such as pick-and-place. Then, anode plate 208 is positioned generally in abutting engagement with edges 118 of spacers 100 so that inner surface 212 of anode plate 202 is facing, and directly opposed to, inner surface 204 of cathode plate 202. Anode plate 208 is aligned above cathode plate 202 so that cathodoluminescent phosphor deposits 210 are directly opposed to pixels 204 and can receive emitted electrons. Edges 118 of spacers 100 are positioned in abutting engagement with plate 208 between cathodoluminescent phosphor deposits 210 and physically contact inner surface 212, as illustrated by dashed lines in FIG. 5. As described above in conjunction with FIG. 1 members 104 of spacers 100 have heights, hS, less than the heights, $h_L$, of members 102. Therefore, members 104 do not physically contact anode plate 208. Cathodoluminescent phosphor deposits 210 are generally fragile, powder-like substances which can be easily removed. Because of their shorter length, members 104 will not contact the inner surface of anode plate 202. Thus, the potential for removal, or disturbance of, cathodoluminescent phosphor deposits 210 is minimized. Members 104 provide stabilization of spacers 100 to maintain the upright position of spacers 100 when subjected to minor mechanical disturbances; members 102 provide a load-bearing, standoff function. Spacers 100 can be affixed to surface 204 of cathode plate 202 by applying glue or frit where edges 116 and/or 120 physically contact surface 204. Affixing spacer 100 to surface 204 can provide additional stability if it is required.

Alternatively, display 200 can be fabricated by placing spacers 100 on anode plate 208 and subsequently positioning cathode plate 202 on the spacer/anode structure.

It is important, in flat panel displays of the field emission type, that the electron emitting surface and the opposed display face be maintained insulated from one another at a relatively small but uniform distance throughout the full extent of the display. There is a relatively high voltage gradient, generally on the order of 1500–5000 volts/millimeter, between the emitting surface and display face. Low voltage applications typically include interplate spacings on the order of 0.20 mm and have a voltage differential of 200–1000 volts. In high voltage applications the interplate spacing is on the order of 1 mm and the voltage differential is within the range of 3000–5000 volts. In either application, members 102, 104 can be coated with an appropriate resistive coating 214 to reduce electrical charging of members 102, 104 and adjust secondary electron emission from members 102, 104. Resistive coating 214 is applied onto substantially all of the exposed surfaces of members 102, 104 before they are joined together or after they are joined together, before spacer 100 is positioned on the display plate. The resistive material comprising coating 214 on member 102 can be different from the resistive material used to coat member 104.

Figure 6:
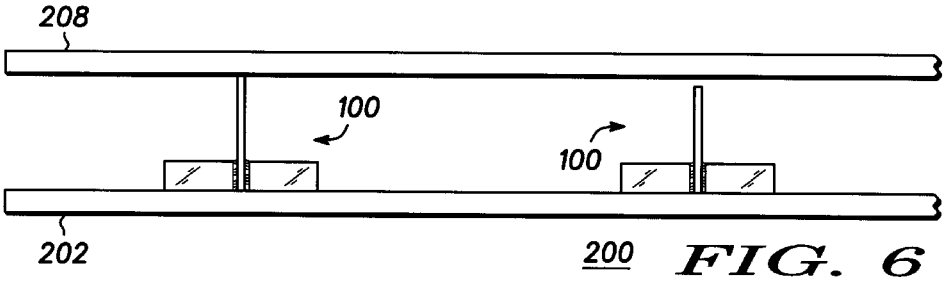
FIG. 6 is a cross-sectional view, as seen from the line 6—6 of FIG. 5, illustrating a field emission display having stand-alone spacers, prior to applying differential pressure.

Referring now to FIG. 6 there is depicted a cross-sectional view, as seen from the line 6—6 of FIG. 5, illustrating field emission display 200 having stand-alone spacers 100, prior to the application of differential pressure. Stand-alone spacers 100 may vary, from spacer to spacer, in height within a few per cent. FIG. 6 is an exaggerated illustration of this variation in height. When anode plate 208 is positioned on spacers 100, after spacers 100 have been placed on cathode 202, anode plate 208 contacts all of spacers 100 or it contacts most of spacers 100 while not contacting the remainder spacers 100.

Figure 7:
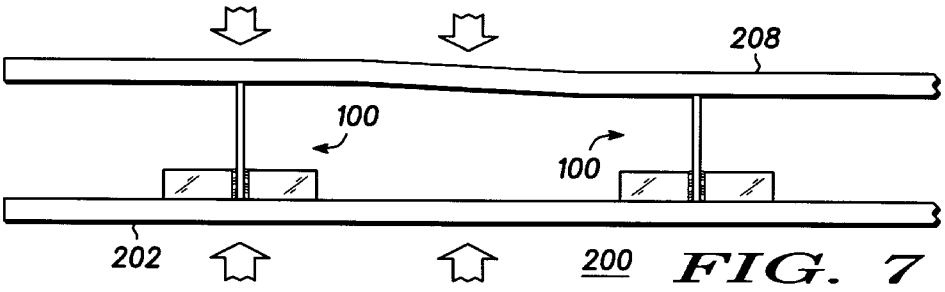
FIG. 7 is a cross-sectional view, similar to FIG. 6, of a flat-panel display having stand-alone spacers and subsequent to applying differential pressure.

Referring now to FIG. 7, there is depicted the same view as illustrated in FIG. 6 and further illustrates the deflection of anode plate 208 due to the application of differential pressure to display 200 upon evacuation of display 200. The arrows in FIG. 7 depict the compressive force due to atmospheric pressure exerted on display 200, after evacuation. Anode plate 208, which can be made of glass, deflects to make physical contact with each spacer 100. This effect is exaggerated in FIG. 7. Cathode plate 202 could similarly deflect to increase the physical contact between plate 202 and spacers 100. In this manner, cathode and anode plates 202, 208 hold, or secure, spacers 100 in place after display 200 has been evacuated and during the lifetime of display 200 when display 200 is used in a manner consistent with its intended, normal use.

Figure 8:
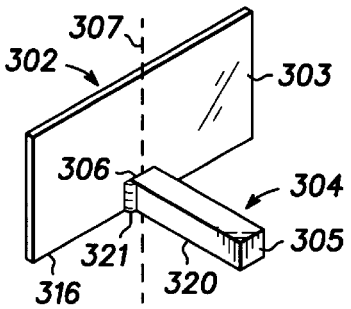
FIGS. 8–10 are isometric views of other embodiments of a stand-alone spacer in accordance with the present invention.

Referring now to FIG. 8 there is depicted a stand-alone spacer 300 in accordance with the present invention. A first, load-bearing member 302 includes a face 303. A second, stabilizing member 304 has opposed ends 305, 306. Members 302, 304 are joined together so that opposed end 306 is in abutting engagement with face 303, substantially at the midpoint of face 303. Members 302, 304 are affixed together by applying a devitrifying frit 321 generally in the region where members 302, 304 physically contact one another. Edges 316, 320 of members 302, 304, respectively, lie in a common plane. In this specific embodiment, members 302, 304 are joined together at a common axis 307 which is located on a line parallel to, and passing generally through the midpoint of, face 303, the line also being perpendicular to edge 316.

Figure 9:
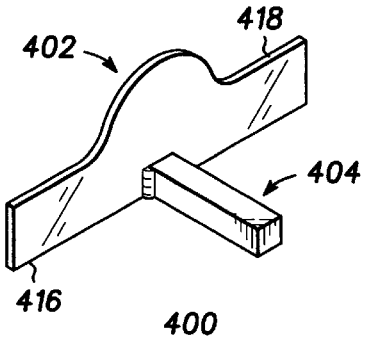

Referring now to FIG. 9 there is depicted an isometric view of a stand-alone spacer 400 in accordance with the present invention. The fabrication, and the spatial and functional relationships between the elements, of spacer 400 is equivalent to those of spacer 300 in FIG. 8. However, spacer 400 includes a first, load-bearing member 402 which has a nonuniform height. Member 402 has opposed edges 416, 418. Opposed edge 418 does not lie in a single plane, while edge 416 does. The distance between edges 416, 418 is nonuniform along the length of member 402. The nonuniform height provides a point of maximum height. When included in a flat panel display, member 402 contacts the face plate substantially only at the point of maximum height. By minimizing the contact of spacer 400 with the face plate of the display, the visibility of spacer 400 to the viewer is minimized. When included in a field emission display, spacer 400 also provides reduced interference with the electron beams in the vicinity of spacer 400.

Illustrated in FIG. 10 is an isometric view of a stand-alone spacer 500 in accordance with the present invention. In this specific embodiment, members 502, 504 have equal heights. Member 502 has a face 503 and an edge 516. Members 502, 504 are joined together at a common axis 507 which is located on a line parallel to, and passing through substantially the midpoint of, face 503, the line also being perpendicular to edge 516.

Figure 11:
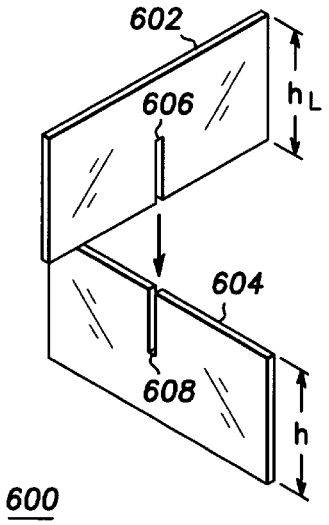
FIG. 11 is an exploded view of another embodiment of the present invention.

Referring now to FIG. 11 there is depicted an exploded view of a stand-alone spacer 600 in accordance with the present invention. Spacer 600 includes a first member 602 and a second member 604. First member 602 includes a slot 606. Slot 606 is positioned generally at the midpoint of the length of member 602. The height of slot 606 is equal to half of the height, $h_L$, of member 602. Second member 604 has a slot 608 for receiving slot 606. The depth of slot 608 is equal to half the height, h, of member 604, which is equal to $h_L$. When slots 606 and 608 are guided into one another, spacer 600 has a height equal to both $h_L$ and h. In this specific embodiment, members 602 and 604 have equal heights. When incorporated into a flat panel display, both members 602, 604 extend generally perpendicularly into both the backplate and the face plate of the display, making physical contact with the inner surfaces of the display plates. Thus, in this specific embodiment both members 602, 604 are load-bearing, providing standoff between the plates. Spacer 600 has a cross-shaped cross-section, and the perpendicularity of members 602 and 604 can be maintained by further affixing members 602 and 604 with devitrifying frit, as illustrated in FIG. 12, which is a top plan view of spacer 600 after a frit 610 has been applied. Members 602, 604 are joined together at a common axis, which lies on a line parallel to slots 606 and 608.

Figure 13:
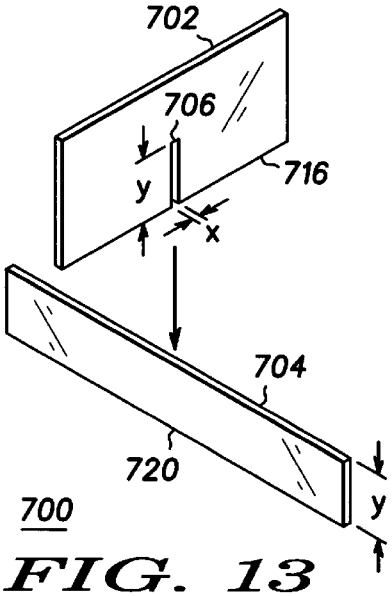
FIG. 13 is an exploded view of another embodiment of a stand-alone spacer in accordance with the present invention.

Illustrated in FIG. 13 is a stand-alone spacer 700 in accordance with the present invention. In this specific embodiment, a first member 702 includes a slot 706 formed in an edge 716. A second member 704 has a height, y, which is less than the height of member 702. The height of slot 706 is also equal to y. The thickness, x, of slot 706 is substantially equal to the thickness of member 704 so that member 704 can be positioned in slot 706. An edge 716 of member 702 and an edge 720 of member 704 are positioned in a common plane, which is placed on the planar, inner surface of one of the plates of a flat-panel display. No additional affixation means or support structures are required to keep spacer 700 upright after the pick-and-place apparatus, or other placement apparatus, is removed.

Referring now to FIG. 14, there is depicted the same embodiment of FIG. 13 and further illustrates the positioning of edges 716, 720 in the same plane when member 704 is positioned in slot 706. Members 702, 704 are joined together at a common axis 707 which lies on a line parallel to slot 706 and passes generally through the midsection of member 704.

Figure 15:
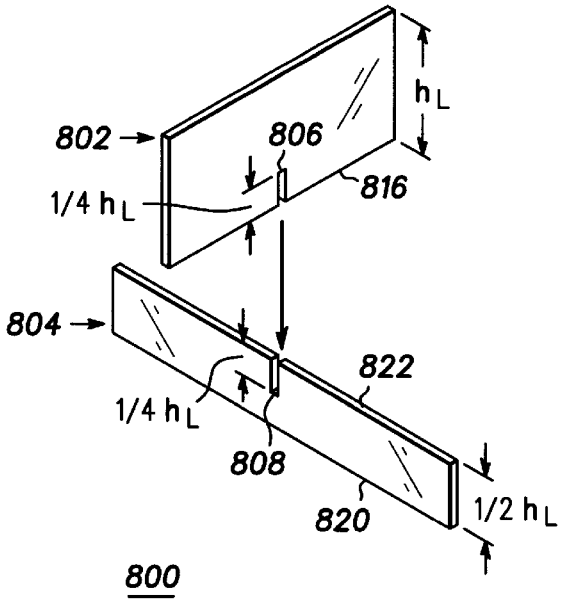
FIG. 15 is an exploded view, similar to FIGS. 11 and 13, of another embodiment of a stand-alone spacer in accordance with the present invention.
Figure 16:
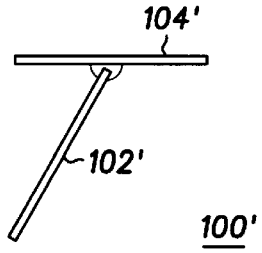
FIGS. 16–22 are top-plan views of other embodiments of a stand-alone spacer in accordance with the present invention.
Figure 20:
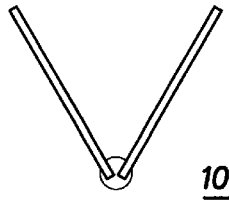
Figure 17:
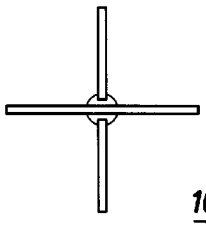
Figure 21:
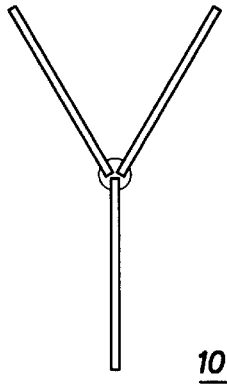
Figure 18:
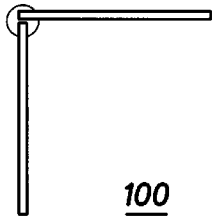

Referring now to FIG. 15 there is depicted an exploded view of a stand-alone spacer 800 including a first, load-bearing member 802 and a second, stabilizing member 804. The height of member 804 is one-half that of member 802, which is depicted as $h_L$ in FIG. 15. A first notch 806 is formed generally in the center of edge 816 of member 802; a second notch 808 is formed generally in the center of an edge 822 of member 804. The depth of notch 806 is one-quarter $h_L$; the depth of notch 808 is also one-quarter $h_L$. Notch 806 is positioned in notch 808 so that edges 816, 820 lie in a common plane. The height $h_L$ is substantially equal to the pre-determined spacing between the back plate and the face plate of the display into which spacer 800 is incorporated. Member 802 provides a load-bearing, standoff function, while member 804 provides a stabilizing function.

Figure 22:
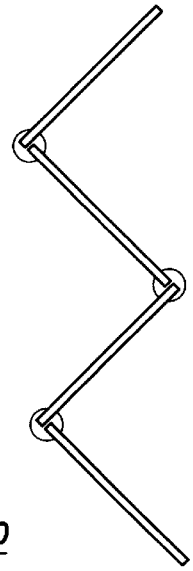
Figure 19:
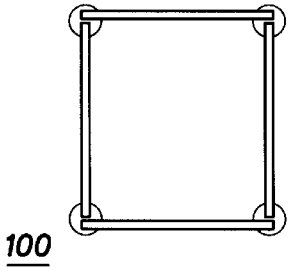

Illustrated in FIGS. 16—22 are cross-sectional views of other embodiments of the present invention. Each cross-section cuts through all of the members of the stand-alone spacer. Illustrated in FIG. 11 is a spacer 100' having a first member 102' and a second member 104'. Members 102' and 104' can have equal or unequal heights. At least one of members 102', 104' must be a load-bearing member having a height substantially equal to the distance between the inner surfaces of the backplate and face plate in the final display. In this specific embodiment members 102' and 104' are positioned at an angle to one another in the range between 0 and 90 degrees. Similarly, FIGS. 17–22 illustrate two or more members being joined together to form a stand-alone spacer in accordance with the present invention. More than two members can be utilized, as illustrated in FIGS. 17, 19, 21, and 22. In each embodiment, one edge of each member lies in a common plane. The members are joined together at a common axis and affixed together by applying frit, as illustrated in FIGS. 16–22; other methods of affixation may be utilized, such as anodic bonding. The cross-sectional shape of the stand-alone spacer may be L-shaped (FIG. 18), v-shaped (FIG. 20), Y-shaped (FIG. 21), square-shaped (FIG. 19), or zig-zag-shaped (FIG. 22). Other cross-sectional shapes are possible. Each embodiment of FIGS. 16–22 has a non-linear, predetermined cross-section (crossing through all of the members) which provides mechanical stability. That is, when the stand-alone spacer is positioned on the generally flat surface of one of the display plates so that the common plane of the spacer is in abutting engagement with the generally flat surface, the stand-alone spacer remains upright during the final packaging and evacuation steps in the fabrication of the display. All of the embodiments in FIGS. 16–22 include at least one member which is a load-bearing member. That is, the height, or the point(s) of maximum height, of the load-bearing member is/are equal to the predetermined distance between the inner surfaces of the plates of the finished display. The height(s) of the remaining member(s) may be less than that of the load bearing member for the reasons described in the discussion of FIGS. 1 and 2 (to minimize interferences with field emission and to minimize disturbance to cathodoluminescent material). The dimensions of these remaining members are such that they provide stability to the stand-alone spacer, causing it to remain upright, and to return to an upright position when subjected to angular displacement during the final packaging steps of the display, subsequent to the placement of the spacers on one of the display plates. A simple moment balance can be performed on the desired spacer geometry for a given tipping situation, and the dimensions determined so that the tipping angle of the spacer is within the range of 20–90 degrees. This can be performed for tipping in all directions and the dimensions derived from the worst-case scenario.

In flat panel displays of the field emission type, a variety of spacer geometries is useful because pixel layouts can vary, resulting in a variety of geometries formed by the inter-pixel surface areas available for spacer placement.

An example is illustrated in FIG. 23, which depicts a simplified, top plan view of a cathode structure 202' having a plurality of pixels 206', which include the field emission devices (not shown). The pixel layout in FIG. 23 is different from that of FIG. 2 and includes alternating, inverted triangles. The surface area between pixels 206' can accommodate the placement of spacer 100', the embodiment illustrated in FIG. 16.

Figure 24:
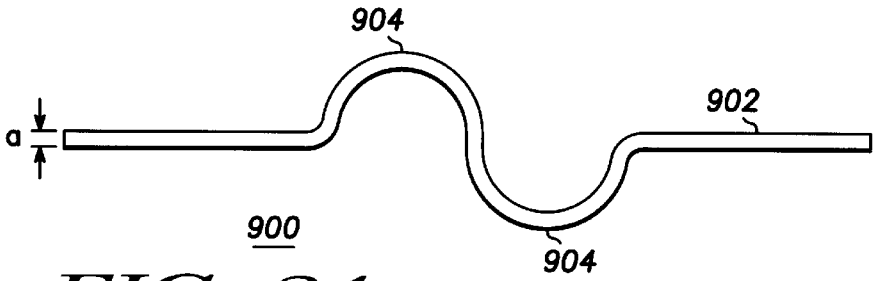
FIG. 24 is a top plan view of another embodiment of a stand-alone spacer in accordance with the present invention, including a single member having stabilizing bends formed in it.
Figure 25:
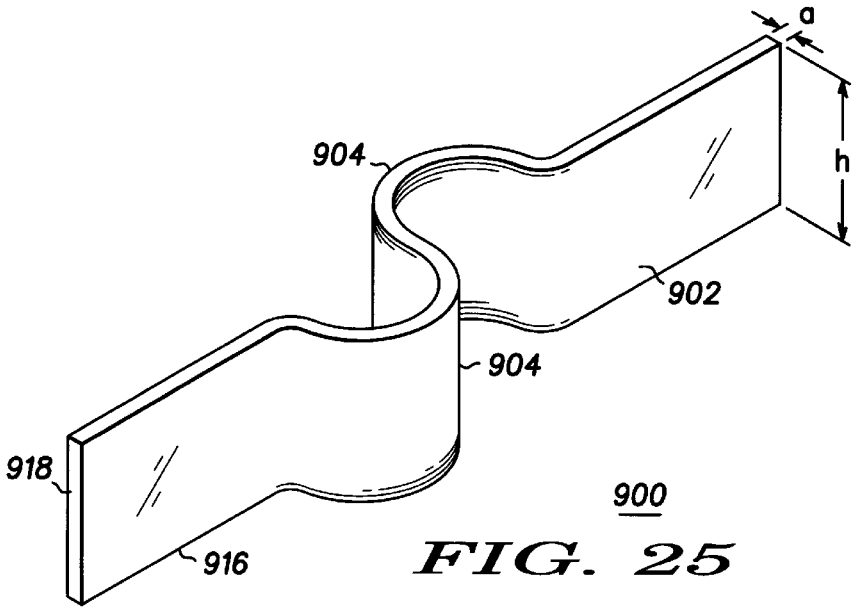
FIG. 25 is an isometric view of the embodiment of FIG. 24.

Referring now to FIGS. 24 and 25, there are depicted top plan and isometric views, respectively, of a stand-alone spacer 900 in accordance with the present invention. Spacer 900 includes a single, continuous member 902 having a pair of bends 904 formed in it. Spacer 900 has an aspect ratio of 10:1: the width, a, of spacer 900 is about 100 micrometers so as to fit in between the pixels of a field emission display, and the height, H, is substantially one millimeter everywhere along the length of spacer 900, which is equal to the predetermined distance between the inner surfaces of the cathode and anode plates of a high-voltage field emission display. Spacer 900 has an edge 916, all of which lies in a common, single plane and can be positioned in abutting engagement with the planar, inner surface of one of the display plates. To incorporate a plurality of spacers 900 into a flat panel display, spacers 900 are positioned, by a method such as pick-and-place, on the inner, planar surface of one of the display plates. When the placement apparatus is removed from spacers 900, bends 904 provide mechanical stability so that spacers 900 remain upright throughout the subsequent, final packaging and evacuation steps of the fabrication of the display. These steps include the placement of the remaining display plate in abutting engagement with second edges 918 of spacers 900.

In another embodiment of spacer 900, the height of spacer 900 is non-uniform along the length of spacer 900 so that one or more points of maximum height, H, are provided. The points of maximum height, H, are formed to be substantially equal to the desired spacing between the plates of the display into which spacer 900 is incorporated. Edge 916 lies in one plane and is placed in abutting engagement with the inner, planar surface of the backplate, or cathode 202 of FIG. 5, of the display; edge 918 contacts the faceplate, or anode plate 208 of FIG. 5, at the one or more points of maximum height so that the visibility of spacer 900 to the viewer is minimized.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. A stand-alone spacer for a flat panel display having a back plate and a faceplate, said stand-alone spacer comprising:

a plurality of members having first and second opposed edges, the first opposed edge of each of the plurality of members having a generally flat surface and being positioned in a common plane, the members being joined together at a common axis, a first one of the plurality of members being a load-bearing member and having an aspect ratio in the range of 2:1 to 20:1, the first one of the plurality of members having a maximum height substantially equal to a predetermined spacing between the inner surfaces of the back plate and faceplate of the flat panel display, the stand-alone spacer having a tipping angle in the range of 20–90 degrees so that when the stand-alone spacer is positioned in an upright position on a planar, inner surface of one of the display plates so that the common plane of the stand-alone spacer is in abutting engagement with the planar, inner surface, the spacer maintains its upright position during the subsequent packaging and evacuation steps in the fabrication of the display, wherein the load-bearing member maintains the predetermined spacing between the back plate and the faceplate of the flat panel display.

2. A stand-alone spacer for a flat panel display as claimed in claim 1 wherein the second opposed edge of the first one of the plurality of members is generally flat and is positioned within a single plane.

3. A stand-alone spacer for a flat panel display as claimed in claim 1 wherein the first one of the plurality of members has a nonuniform height to provide at least one point of maximum height, the second opposed edge of the first one of the plurality of members contacting one of the plates of the display at the at least one point of maximum height.

4. A stand-alone spacer for a flat panel display as claimed in claim 1 wherein at least one member is made of ceramic.

5. A stand-alone spacer for a flat panel display as claimed in claim 1 further including a resistive coating covering the surfaces of the first one of the plurality of members, wherein the resistive coating reduces the electrical charging and adjusts the secondary electron emission from the first one of the plurality of members.

6. A stand-alone spacer for a flat panel display as claimed in claim 1 wherein a second member has first and second opposed faces and wherein the first member has first and second opposed ends, the first end of the first member being affixed to the first face of the second member.

7. A stand-alone spacer for a flat panel display as claimed in claim 6 wherein the first and second members are positioned 90 degrees relative to one another.

8. A stand-alone spacer for a flat panel display as claimed in claim 1 wherein the first one of the plurality of members has a maximum height of one millimeter and a maximum width of 100 micrometers and has an aspect ratio of 10:1.

9. A stand-alone spacer for a flat panel display as claimed in claim 7 wherein the second one of the plurality of members has a width of 70 micrometers and a length of 1.3 millimeters and wherein the first one of the plurality of members has a length of 5 millimeters, a height of one millimeter, and a width of 100 micrometers so that the tipping angle is 35 degrees.

* * * * *